US006457279B1

(12) United States Patent
Jacobsen et al.

(10) Patent No.: US 6,457,279 B1
(45) Date of Patent: Oct. 1, 2002

(54) FLASHING MEMBER AND FRAME FOR A ROOF-PENETRATING BUILDING PART

(75) Inventors: Per Jacobsen, Horsens; Jens Troels Plesner Kristensen, Gedved, both of (DK)

(73) Assignee: VKR Holding A/S, Soborg (DK)

( * ) Notice: Subject to any disclaimer, the term of this patent is extended or adjusted under 35 U.S.C. 154(b) by 0 days.

(21) Appl. No.: 09/647,986

(22) PCT Filed: Mar. 25, 1999

(86) PCT No.: PCT/DK99/00170

§ 371 (c)(1),
(2), (4) Date: Nov. 20, 2000

(87) PCT Pub. No.: WO99/51835

PCT Pub. Date: Oct. 14, 1999

(30) Foreign Application Priority Data

Apr. 7, 1998 (DK) ..... 0494/98

(51) Int. Cl.[7] ..... E04D 13/14

(52) U.S. Cl. ..... 52/58; 52/60; 52/61; 52/62; 52/219; 52/556; 52/557; 52/97; 52/200; 52/198; 52/96

(58) Field of Search ..... 52/58, 60, 61, 52/62, 219, 556, 557, 97, 200, 198, 96

(56) References Cited

U.S. PATENT DOCUMENTS

| | | | | |
|---|---|---|---|---|
| 3,698,142 A | | 10/1972 | Theriault | |
| 4,603,517 A | * | 8/1986 | Lyons, Jr. | 52/60 |
| 4,951,431 A | | 8/1990 | Sweers | |
| 5,072,552 A | * | 12/1991 | Sauder | 52/58 |
| 5,581,959 A | * | 12/1996 | Occhipinti | 52/58 |
| 5,605,019 A | * | 2/1997 | Maziekien et al. | 52/58 |
| 5,675,940 A | * | 10/1997 | Bahar et al. | 52/58 |
| 5,884,435 A | * | 3/1999 | David et al. | 52/62 |
| 5,894,697 A | * | 4/1999 | Hunter | 52/58 |

FOREIGN PATENT DOCUMENTS

| | | |
|---|---|---|
| DE | 2142733 | 3/1973 |
| GB | 2189275 | 10/1987 |
| SE | 416072 | 11/1980 |

* cited by examiner

*Primary Examiner*—Lanna Mai
*Assistant Examiner*—Dennis L. Dorsey
(74) *Attorney, Agent, or Firm*—Venable; John P. Shannon; Chad C. Anderson

(57) ABSTRACT

A flashing frame for a roof-penetrating building part, in particular in a roof window frame, comprises mutually connected frame members (6, 12) of weather-shielding material for positioning along the sides (1–4) of the roof-penetrating building part adjoining the roofing. The frame members for positioning along sides (3, 4) of the roof-penetrating building member, which do not extend perpendicularly to the pitch of the roof, consist of flashing members (7) designed as L-profiles with a profile wall (8) for positioning at least partially under the roofing (5), and an upright profile wall (9) for positioning in abutment against the side of the roof-penetrating building part. Flashing members (7) are placed in the side frame members in extension of each other with mutual overlapping. The upright profile wall (9) is provided with a comparatively closely packed, substantially equidistant, transverse profiling (10) and with locking means (11) for mutaul locking of the mutually overlapping parts of the neighbouring flashing members (7).

8 Claims, 2 Drawing Sheets

FLASHING MEMBER AND FRAME FOR A ROOF-PENETRATING BUILDING PART

CROSS-REFERENCE TO RELATED APPLICATIONS

This application claims priority of Danish Application No. PA 1998 00494, filed Apr. 8, 1998, and International Application No. PCT/DK 99/00170, filed Mar. 25, 1999, and published as WO 99/51835 on Oct. 14, 1999. The disclosure of each of the foregoing documents, as well as that of each U.S. and foreign patent and patent application mentioned in the specification of the present application, is incorporated herein by reference.

BACKGROUND OF THE INVENTION

The present invention relates to a flashing member for a flashing frame for weather-shielding connection of a roof-penetrating building part to an adjacent roofing, said member comprising an L-profile with a first profile wall for positioning at least partially under the roofing and a second, upright profile wall for positioning along a side of the roof-penetrating building part facing the roofing.

Flashing frames composed partly of mutually overlapping flashing members of this type are known for instance from U.S. Pat. No. 4,951,431 and SE-B-416072 for flashing of roof-penetrating building parts like chimneys, walls, etc.

The invention aims in particular at providing an improved flashing frame of the type in question for weather-shielding mounting of the frame structure of a roof window in a pitched roof, in particular one with flat roofing, for instance slates, but may also be adapted to other types of roof-penetrating building parts like for instance chimneys, air shafts and the like.

When mounting roof windows in such pitched roofs, it is i.a. known from DE-B-21 42 733 to use mutually overlapping frame members in the form of L-profiles in abutment against the sides of the window frame in parallel with the pitch of the roof. In this known design, the upright profile wall of the L-profiles has a comparatively low height, such that for its weather-shielding connection with a superjacent covering member on the frame side, a separate insert profile with hook-and/or bead-shaped engagement means is needed for sealing connection with the upright profile wall of the L-profile and the superjacent frame covering member, respectively.

Though it is thereby possible to avoid the otherwise necessary securing of the upright wall of the L-profile to the frame side member, which mostly consists of wood, by means of screws or nails which are driven through the upright profile wall and which may give rise to a subsequent risk of water-penetration into the frame side member and possibly the roof structure itself, the construction becomes complicated and more expensive and the mounting is made difficult on account of the special, separate insertion profile.

BRIEF SUMMARY OF THE INVENTION

On this background, it is the object of the invention to provide a flashing member which is designed in such a manner that several individual members in a simple manner may be connected in partly overlapping relationship in extension of one another under mutual interlocking of overlapping members to prevent relative displacement thereof for the formation of a continuous frame member, and which is at the same time simple in manufacture and easy to handle and mount on the building site without the use of screws, nails or the like fastening members for securing to the roof-penetrating building part.

To meet this object the flashing member according to the invention is characterized in that the upright profile wall is provided with a profiling for engaging a corresponding profiling in the upright profile wall of an overlapping, longitudinally displaced neighbouring member in the flashing frame for preventing longitudinal displacement between said members and provided with integral locking means for locking the member relative to said neighbouring member, said locking means comprising a protruding, locking flap at at least one end of the member, said locking flap being bendable to a locking position by manual deformation.

In a preferred embodiment of the flashing member, the profile may be manufactured by punching of sheet flashing material, for instance aluminium sheet material, followed by profiling of the upright profile wall, which may advantageously consist of a pleating or corrugation with comparatively closely packed foldings or waves as know per se from GB-A-2189275. On the installation site, the L-profiles are easily and quickly connected in extension of each other under mutual overlapping, and the overlapping parts of the two neighbouring members are mutually interlocked by means of the manually bendable locking flaps.

Advantageous embodiments of such a flashing member are stated herein.

Moreover, the invention relates to a flashing frame for weather-shielding connection of a roof-penetrating building part to an adjacent roofing, in particular in a pitched roof, which frame comprises mutually connected frame members of weather-shielding material for positioning along the sides of the roof-penetrating building part, said sides facing the roofing, whereby frame members for positioning along sides of the roof-penetrating building member which do not extend perpendicularly to the pitch of the roof consist of flashing members positioned in extension of each other with mutual overlapping as explained above.

According to the invention such a flashing frame is characterized in that for positioning against sides of the roof-penetrating building part, which extend perpendicularly to the pitch of the roof, the flashing frame comprises throughgoing frame members for abutment against said sides in their entire extension, a frame member for positioning against an upperside of the roof-penetrating building part being designed as a hood-like member for overlapping the upper flashing member in each adjacent side frame member.

In addition to the advantages described above, this design of the side frame members makes a sealing connection possible of the throughgoing frame members for positioning against the sides of the roof-penetrating building part which are perpendicular to the pitch of the roof, for instance top and bottom members of the frame for a roof window.

BRIEF DESCRIPTION OF THE DRAWINGS

The invention will now be explained in the following with reference to the schematic drawing, in which.

DETAILED DESCRIPTION OF THE INVENTION

Figure 1:
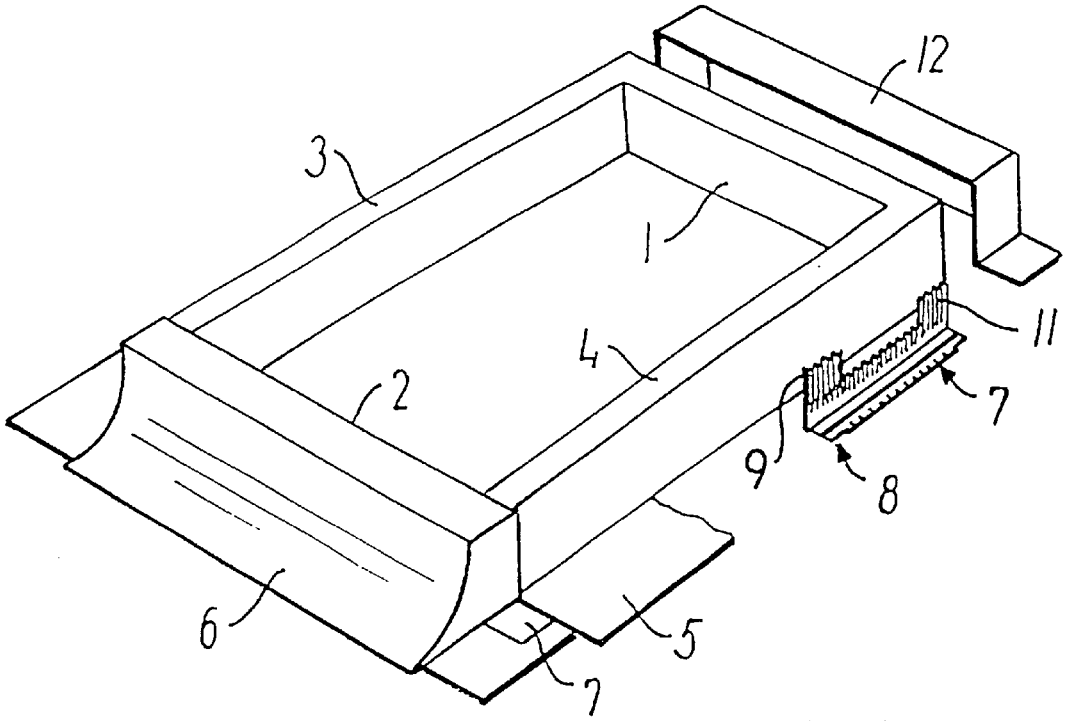
FIG. 1 is a perspective view of an embodiment of a flashing frame comprising side frame members consisting of flashing members according to the invention, FIG. 2 an embodiment of a flashing member according to the invention, and FIG. 3 example of a side frame member consisting of flashing members as shown in FIG. 2 mounted along one side of a roof-penetrating building part in the form of a chimney in connection with a roof covering of slates.

In the embodiment shown in FIG. 1 of a flashing frame for weather-shielding connection of the frame structure of a roof window, said frame structure consisting of top and bottom members 1 and 2 and side members 3 and 4 for a roofing consisting of slates 5, the flashing frame comprises a throughgoing bottom member 6 to be positioned against the frame bottom member 2 in its entire extension and secured thereto, for instance by means of screws.

Figure 2:
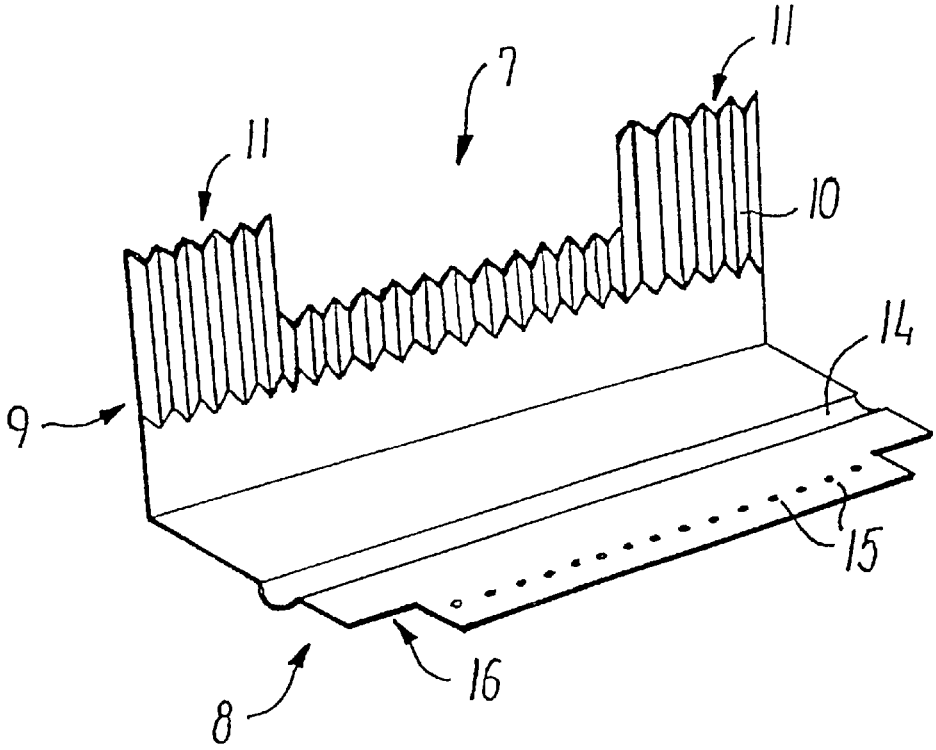

For mounting against the frame side members 3 and 4, the flashing frame comprises side frame members composed of flashing members 7 in the form of L-profiles which, as more clearly shown in FIG. 2, comprise a profile wall 8 in parallel with the roof and which at least partially may be inserted under the slate 5, and an upright profile wall 9 provided with a transverse profiling, for instance as shown in the form of a pleating with comparatively, closely packed, equi-distant foldings 10.

According to the invention, the upright profile walls 9 are further at least at one end provided with locking means, preferably in the form of a protruding locking flap 11, which after the positioning of the members 7 in extension of one another under mutual overlapping may be manually bent over for locking of the overlapping parts of neighbouring members 7.

The locking flap 11, which in the not bent position shown in FIG. 2, protrudes from the upright profile wall 9 in plane therewith, is provided with the same profiling as the upright wall 9 and with a width, which comprises for instance two to six of the foldings 10 of the pleating. In this manner an effective locking of the overlapping parts of the flashing members is obtained, such that the side frame members composed of the members are kept in close abutment against the frame side members 3 and 4 without being secured thereto by means of screws, nails or the like.

After mounting of the members 7 in extension of one another against the frame side members 3 and 4, the flashing frame is finished by a throughgoing top member 12 which, as shown, may have a hood-like shape for partial overlapping of the upper flashing members 7 in each side frame member.

As shown in FIG. 2, the profile wall 8 of the flashing member 7 intended for being positioned under the roofing may preferably be provided with corner recesses 16 of the same size and shape as the locking flaps 11, such that the flashing members 7 may be manufactured from a sheet material without any waste of material.

Figure 3:
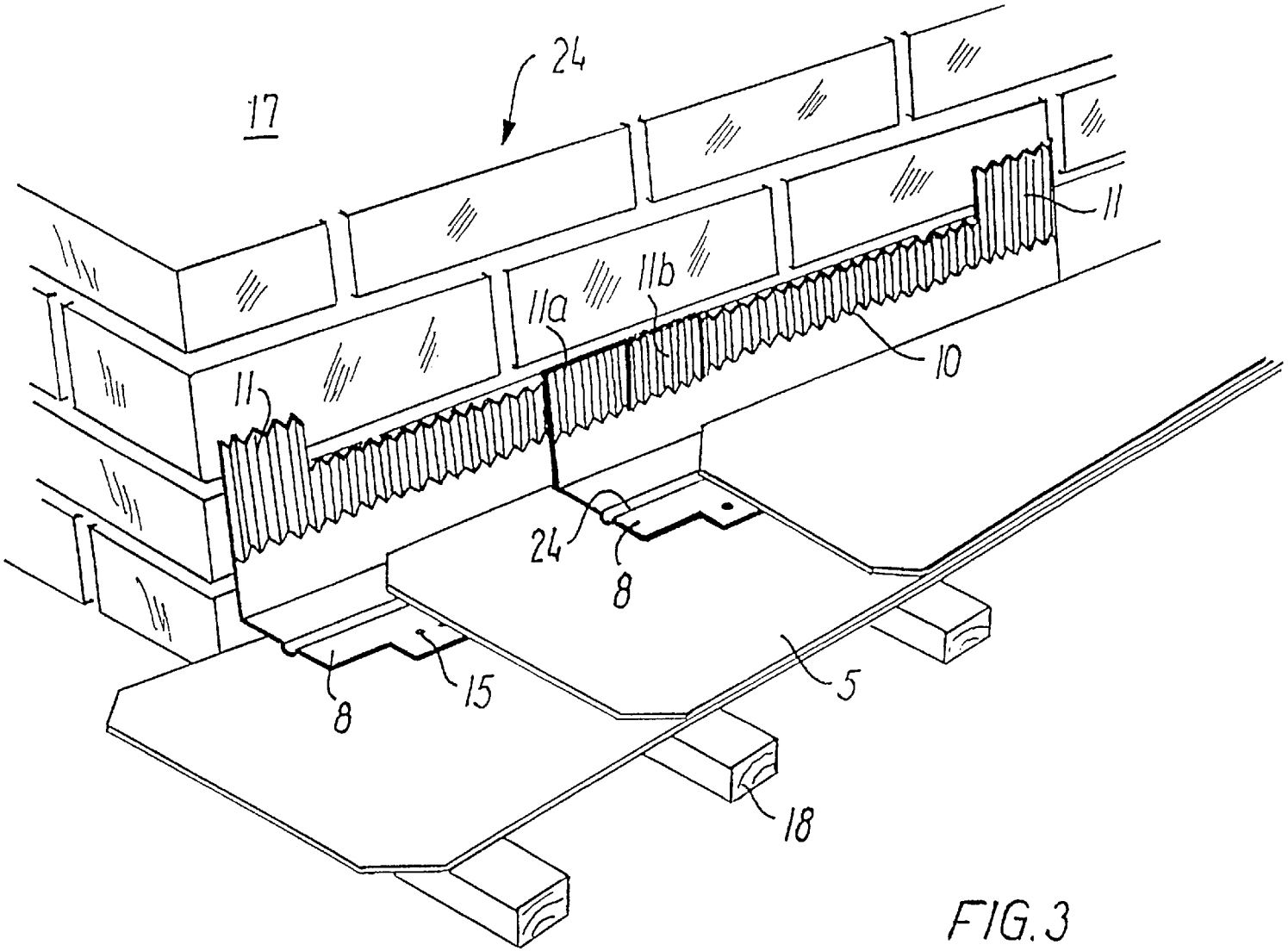

In the embodiment shown in FIG. 2, the flashing member 7 is provided with two locking flaps 11 and corresponding thereto, the profile wall 8 is provided with two corner recesses 16. In this way the same design of the flashing member 7 may be used on all sides of a roof-penetrating building part which are not perpendicular to the pitch of the roof, and a correct overlapping in respect of water drainage is obtained between neighbouring members as will be seen from FIG. 3, which shows the overlapping between two neighbouring members 7 with locking flaps 11*a* and 11*b* in bent locking position for providing a side frame member for mounting against one side of a roof-penetrating building part in the form of a chimney 17.

Furthermore, a longitudinal groove 14 may optionally be provided in the profile wall 8, in which groove a sealing member for sealing against the underside of the roofing may be placed, and the profile wall 8 may further have pre-made nailholes 15 for use in securing the flashing members to battens in the subjacent roof structure.

What is claimed is:

1. A flashing member for a flashing frame for weather-shielding connection of a roof-penetrating building part (1–4, 24) to an adjacent roofing (5), said member (7) comprising an L-profile with a first profile wall (8) for positioning at least partially under the roofing (5) and a second, upright profile wall (9) for positioning along a side of the roof-penetrating building part (1–4, 24) adjoining the roofing, characterized in that the upright profile wall (9) has a profiling (10) for engaging a corresponding profiling in a corresponding profile wall of an overlapping, longitudinally displaced adjacent member in the flashing frame for preventing longitudinal displacement between said member and said adjacent member and integral locking means (11) for locking said member (7) relative to said adjacent member, said locking means comprising a protruding, locking flap (11) at at least one end of the member (7), said locking flap (11) being bendable to a locking position by manual deformation.

2. A flashing member according to claim 1, characterized in that said profiling (10) is a transverse profiling.

3. A flashing member according to claim 2, characterized in that said transverse profiling (10) comprises a pleating or corrugation with comparatively closely packed foldings or waves.

4. A flashing member according to claim 1, characterized in being provided with locking flaps (11*a*, 11*b*) at both ends.

5. A flashing member according to claim 1, characterized in that in said first profile wall (8) at the same end of the member as each locking flap (11), a corner recess (16) is provided having the same size and shape as said locking flap (11).

6. A flashing member according to claim 1, characterized in that in said first profile wall (8) a longitudinal groove (14) is provided for receiving a sealing member abutting the underside of the roofing.

7. A flashing member according to claim 1, characterized in that said first profile wall (8) is provided with pre-made nailholes for securing the member to a subjacent roof structure (18).

8. A flashing frame for weather-shielding connection of a roof-penetrating building part (1–4, 24) to an adjacent roofing (5), said roof being pitched and said roof-penetrating building part having first sides not extending perpendicular to the pitch of the roofing and second sides extending perpendicular to the pitch of the roofing, one of the second sides being an upperside roof-penetrating building part, said frame comprising mutually connected frame members (6, 7, 12) of weather-shielding material to be positioned along the first and second sides (1–4) of the roof-penetrating building part, said frame members of weather-shielding material including flashing members, said first and second sides adjoining the roofing, wherein the flashing members (7) are positioned along the first sides (3, 4) of the roof-penetrating building member in extension of each other with mutual overlapping, said flashing members each including an L-profile with a first profile wall (8) for positioning at least partially under the roofing (5) and a second, upright profile wall (9) for positioning along the first sides of the roof-penetrating building member, wherein the upright profile wall (9) has a profiling (10) for engaging a corresponding profiling in a corresponding profile wall of an overlapping, longitudinally displaced adjacent flashing member for preventing longitudinal displacement between said flashing members, and integral locking means (11) for locking the flashing member (7) relative to said adjacent flashing member, said locking means comprising a protruding, locking flap (11) at at least one end of the flashing member (7), said locking flap (11) being bendable to a locking position by manual deformation characterized in that, for positioning against the second sides (1,2) of the roof-penetrating building part, the flashing frame comprises throughgoing frame members (6, 12) for abutment against said second sides in their entire extension, said throughgoing frame members including an upperside frame member (12) for positioning against the upperside (1) roof-penetrating building part and being designed as a hood-like member for overlapping an uppermost flashing member (7) on each of the first sides adjacent the upperside frame member.

* * * * *